United States Patent [19]

von der Eltz et al.

[11] 4,202,112

[45] May 13, 1980

[54] PROCESS FOR THE UNIFORM DYEING OF TEXTILE MATERIAL WEBS WITH THE AID OF A UNIFORM PRE-DRYING

[75] Inventors: Hans-Ulrich von der Eltz, Frankfurt am Main; Siegfried Glander, Bad Soden am Taunus, both of Fed. Rep. of Germany

[73] Assignee: Hoechst Aktiengesellschaft, Frankfurt, Fed. Rep. of Germany

[21] Appl. No.: 858,897

[22] Filed: Dec. 8, 1977

[30] Foreign Application Priority Data

Dec. 10, 1976 [DE] Fed. Rep. of Germany ..... 2655972

[51] Int. Cl.[2] ..... F26B 3/28

[52] U.S. Cl. ..... 34/4; 34/41

[58] Field of Search ..... 34/4, 48, 52, 41

[56] References Cited

U.S. PATENT DOCUMENTS

| | | | |
|---|---|---|---|
| 3,040,807 | 6/1962 | Chope | 34/48 |
| 3,214,845 | 11/1965 | Huffman | 34/48 |
| 3,358,378 | 12/1967 | Downs | 34/48 |
| 3,731,520 | 5/1973 | Hickman et al. | 34/48 |
| 3,793,741 | 2/1974 | Smith, Jr. | 34/48 |
| 3,848,342 | 11/1974 | Bartles et al. | 34/48 |

*Primary Examiner*—John J. Camby

*Attorney, Agent, or Firm*—Curtis, Morris & Safford

[57] ABSTRACT

Process for the uniform pre-drying of damp textile material webs, subsequent to a continuous wet treatment operation, including measuring the moisture content remaining on the textile material, wherein, in the course of the material run, immediately behind an infrared pre-drying tunnel for the continuously fed material, several measuring positions are arranged transversely to the transport direction of the material, and measurements of the residual moisture are made by means of a contactless method, determining measuring pulses in this manner and transmitting these to the control elements of the preceding pre-dryer and within the heating power is controlled of several separately controllable heating fields, distributed across the width of the drying tunnel, in agreement with the measured values of the moisture.

9 Claims, 2 Drawing Figures

Figure 2:
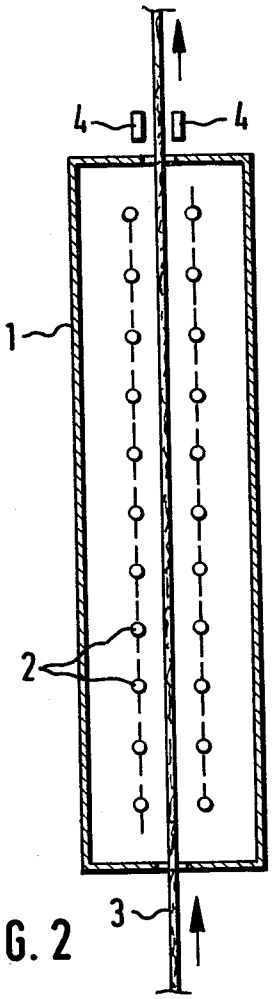

PROCESS FOR THE UNIFORM DYEING OF TEXTILE MATERIAL WEBS WITH THE AID OF A UNIFORM PRE-DRYING

The continuous dyeing processes developed after the introduction of synthetic fibers, in which processes an intermediate drying of the textile material impregnated with the dyes is necessary before the fixation, have led to the development of pre-drying units, with the help of which the damp textile material is to be dried, as far as possible without contact, sufficiently so that in the subsequent final drying of the material no further migration effects of the dyes can occur. The pre-drying unit used most widely in practice for this purpose is the infrared pre-drying tunnel.

The monitoring of a pre-drying in the infrared tunnel has, however, hitherto always given rise to great difficulties. These arise particularly from the fact that it is not yet possible to check the uniformity of the drying across the fabric web. As a result of the non-uniformity, however, the material again suffers, and it can happen that synthetic material undergoes partial setting, changes in the fibers and the like as a result of local overheating. This all leads to a non-uniform dyeing result. The wicking action of a variably damp material also cannot be ignored, as in a material made of 100% polyester fibers, a migration is still possible even below 5% of residual moisture.

The mode of operation with the pre-drying tunnel still causes, even today, great difficulties in textile work and the faults of dyeings produced in this manner, caused by unsatisfactory drying results, can only be partially rectified or improved by expensive repair processes and re-dyeing processes. Thus, it has not been possible hitherto to measure accurate moisture values across the whole width of the material. The pre-drying can also not be controlled across the whole width. However, for reasons of levelness, the material while still damp must not come into contact with sliding contacts. In addition, the measurement of the residual moisture at a single position is not adequate for the purpose of a controlled pre-drying.

On the other hand, the appearance of material which has once been unevenly dried in the pre-drying tunnel can, however, no longer be corrected by the subsequent drying and fixation process. Color deviations or markings in the dyed material remain always more or less visible. When too damp or too dry material is fed to the final dryer or to the thermosol equipment either the desired drying effect is not achieved, or on the other hand the depth of color obtained is not sufficient on account of different fixation conditions, or in both cases unnecessary power is consumed.

For all these reasons there was an urgent need to be able to determine accurately the residual moisture of pre-dried or intermediately dried material webs, in order to obtain a check in this way on the process taking place on the textile material.

The object of the present invention is therefore to design a process for the uniform pre-drying of damp textile material webs, subsequent to a continuous wet treatment operation in the dyeing or finishing of fiber materials, with the aid of a measurement of the moisture content remaining on the textile material, with which process the difficulties which were discussed above and which are known in the state of the art in this field of work, can be rectified.

This object is achieved according to the invention when, in the course of the material run, immediately behind an infrared pre-drying tunnel for the continuously fed material, several measuring positions are arranged transversely to the transport direction of the material, and measurements of the residual moisture are made at these positions on the textile material by means of a contactless method, the measuring pulses determined in this manner are transmitted with low inertia to the control elements of the preceding pre-dryer, and there the heating power of several separately controllable heating fields, distributed across the width of the previously mentioned drying tunnel, is controlled in agreement with the measured values of the moisture, obtained at the corresponding measuring positions.

According to the present invention, the moisture value, determined by the measuring position, is the basis for the control of the heating power of the pre-dryer. In order to ensure a useful control of the drying operation, the infrared pre-drying tunnel is sub-divided into at least two, but more advantageously into three or, still better, four fields which in turn are opposite at least two to four measuring positions across the width of the material web, after the pre-dryer. The most certain way is to provide at least as many measuring positions, across the width of the material, as there are control possibilities at the drying tunnel.

In the claimed process, it is appropriate if the desired residual moisture of the fabric (moisture-desired value) is preset by being programmed into a limiting value circuit and in this way a reference system for the residual moisture is provided. According to this novel technique, from the first moment of starting up the drying process, the heating power of the predrying tunnel increases across the whole width until the residual moisture (moisture-actual value) produced by it and then measured corresponds to this limiting value. During the course of the drying operation, the amount of moisture present at any moment is measured continuously across the width of the material web and, likewise continuously and even almost without delay, it is adjusted to the set limiting value of the moisture, in such a manner that the same value of the residual moisture results across the whole width of the material.

According to the process, the control of the heating power of several heating fields is effected automatically across the width of the material, by means of electronic control. With a pre-dryer with its many measuring positions, it will hardly be possible any more to effect manual control when there are at least four controllable heating fields; where there are less than four controllable heating fields, however, the pre-drying cannot be set individually and accurately enough. In addition, the delay at the pre-dryer must be kept as small as possible. With the setting of a desired temperature and ventilation limit, a further reference system is provided by the process claimed, by which the heating power of the pre-drying tunnel is accordingly set. The heating power is increased or decreased according to the speed of the material.

The drying unit employed according to the invention is constructed in such a way that it contains controllable and non-controllable heating fields. However, the heating fields which can be switched on and off, and can be controlled, do not extend across the whole width of the material. They are arranged in such a manner that several heating fields of this type, across the width of the material, can separately heat at the edges and in the center. Thus, by these means, a fabric is pre-dried in such a way that the same residual moisture is exhibited everywhere, according to whether the left hand or the right hand edge dries more strongly, or the dye on this side mirgrates more strongly. In general the practice is to leave the base load of the infrared pre-drying tunnel uncontrolled and to regulate the control load with the aid of the moisture measurement on the textile material.

The principle of the present invention consists in the immediate, that is to say inertia-less or undelayed, transmission of measured values of the moisture to the control of the heating power of the pre-drying tunnel. In this process the heating fields themselves, as well as, with appropriate circuitry, each radiator are controlled individually, so that an impeccable matching of the heating power to the fabric surface or to the fabric structure is effected. As mentioned already, the transmission of the measured values is effected without inertia. This means that, for example, faulty portions due to differing dye application, can no longer occur.

In the process according to the invention for the control of the pre-drying, it is possible to distribute not only heating fields across the area of the width of the material. On the contrary, individual radiator rods with shortened lengths can also be used, arranged across the width of the material. These can be switched on or off individually or in particular series. However, it has been found to be particularly advantageous in this connection that it is not necessary to actually switch the heating sources on and off if the particular power of the radiator is adjusted by control of the current supply. However, to prevent the effects of the temperature radiation from acting "stepwise", it is advantageous, particularly with lower material speeds, to produce a conventional distribution by means of a circulation device. By this means it is now also possible to control the air flow conditions within the tunnel since the power of the circulation device is also controlled by the moisture measurement. A further control possibility is the amount of the fresh air sucked in.

Figure 1:
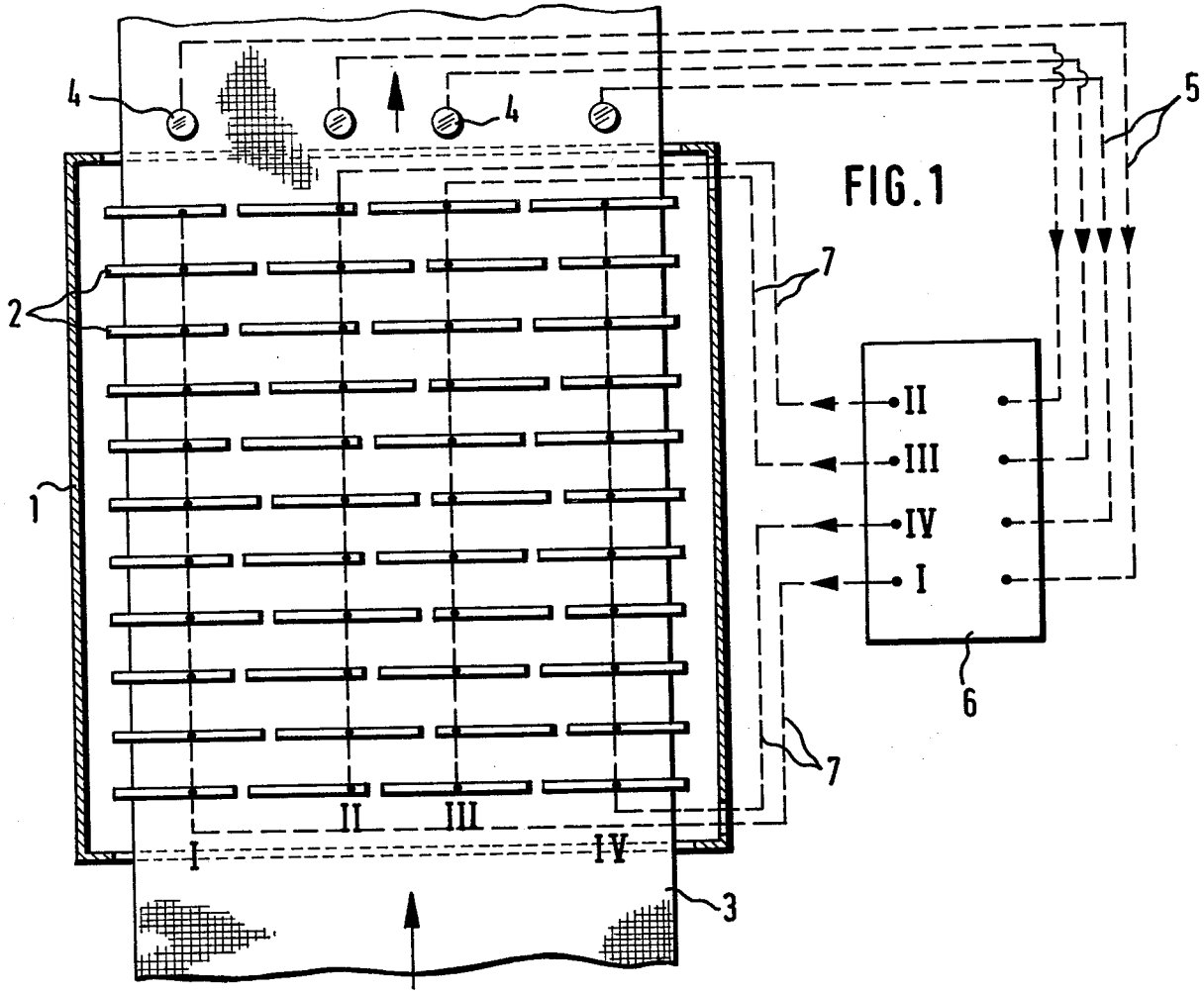

An apparatus which is suitable for carrying out the process of the invention is illustrated by the FIGS. 1 and 2 herein.

A plan view as shown in FIG. 1 and a side view as shown in FIG. 2 illustrate an infrared drying tunnel.

The apparatus as shown consists essentially of an enclosure 1 of the infrared tunnel containing the infrared radiator rods 2 which form four intersecting, however electrically independent (from each other), heating fields I–IV.

The textile material web 3 to be dried (coming from an impregnation device) passes the infrared drying tunnel in the direction of an arrow. The textile material web is conducted through the heating fields I–IV between an upper and a lower row of radiator rods 2.

At the end of the infrared drying tunnel, across the width of the textile material web, are arranged four moisture measuring positions 4 which give their measured values via wires 5 to the regulating and controlling device 6. In this device 6 the measured values are compared with a given moisture value and thus the supply of energy 7 to the heating fields is individually regulated. In this mode it is possible, if the textile material web shows too high moisture values, for instance at the measuring positions correlated to the heating fields I and III, to add to the heating fields I and III more energy and thus to dry more intensely in the region of the heating fields I and III until the measured value of moisture is concordant with the given moisture value and with the moisture value for the heating fields II and IV.

According to the claimed mode of operation, the contactless moisture measurement of the textile material and the control of the controllable heating fields with low inertia can be effected with the aid of a measuring method based on microwave adsorption or microwave reflection, or on the basis of infrared absorption or infrared reflection. In this connection use may advantageously be made according to the device described in copending application Ser. No. 858,893 (CMS Docket No. 265936) filed on the same day as the present application. This concerns a device for the simultaneous determination of the moisture content at the sides and in the center of textile webs, with which device the amount of liquor applied to sheet-like structures can be measured, even in the range of high moisture and which consists of microwave transmitters (horn transmitters) distributed across the width of the material web and connected to a microwave oscillator, and appropriately arranged microwave receivers. The measuring principle of the equipment which operates by microwave absorption and which has the purpose of determining the influence on the microwave power which passes from the transmitters through the material web to the receivers, is used to control the pre-dryer. The measuring equipment can be provided with as many horn transmitters and receivers as there are control possibilities existing on the pre-dryer. The measurement of the residual moisture is effected across the width of the material web immediately behind the pre-drying tunnel. The indication of the measured value is effected without delay and gives a control pulse in the mV range, which is employed for the setting of the heating power of the pre-dryer. The accuracy of the measurement lies between 0.5 and 3%. By modulation of the microwave frequency of the oscillator (for example 2.4 to 3.7 cm wavelength), a time-consuming adjustment of the equipment is dispensed with, and the position of the material web as well as the fluttering of the latter during the measurement no longer have any effect.

Compared with a measuring method which has already been introduced in practice, and which operates with the aid of a reflected microwave beam and which possesses only a single measuring position which traverses to and fro in a zig-zag manner across the material, the device described here has the advantage that it possesses at least three horn transmitters across the width of the material web with appropriately located receivers. With a traversing guidance of the measuring head there is not only a great tendency for faults in the equipment, but the corrections are, in addition, much too time-consuming. Moreover, in this traversing measurement, the running of the material adversely affects the measured results.

Compared with the hitherto customary methods for controlling the residual moisture content, a whole series of advantages which characterize the new technique can be achieved with the aid of the process according to the invention:

As already mentioned above, the new mode of operation results in a much lower loss of material due to uneven drying, in contrast to the hitherto empirical settings for the desired residual moisture and for a uniform moisture across the width of the material.

A changeover can be made, during the material run, without particular difficulty, to the pre-drying of a different textile grade, thus also permitting the use of smaller yardages. The organization in a works is therefore much more flexible. A much more even dyeing is obtained across the width of the material web.

The residual moisture can be set with impeccable reproducibility across the textile web. This is possible at any time even if the same grades of material are run at intervals of weeks or even months. The moisture measurement without inertia permits, of course, the immediate setting of the material speed, for example to a different material grade.

According to the invention, a uniform pre-drying to the desired residual moisture value can be effected even with textile webs which have received a variable wettability across the width as a result of the pre-treatment.

Different fixation conditions for non-uniform material surfaces are dispensed with.

It is also possible without difficulty, according to the new process, to influence the heating power of gas burners, installed in the pre-drying tunnel, for example, by throttling the gas supply by a means using the results of the moisture measurements.

What is claimed is:

1. A process for the uniform pre-drying of damp textile material webs in an infrared pre-drying tunnel, subsequent to a continuous wet treatment operation in the dyeing or finishing of fiber materials, including: measuring a moisture content remaining on said textile material web, wherein, in the course of a material run, immediately following an infrared pre-drying tunnel for the continuously fed material, several measuring positions are arranged transversely to the transport direction of said material; determining the residual moisture at these positions on said textile material web, by means of a contactless method, whereby measuring values in form of pulses are obtained; transmitting said measuring pulses with low inertia to a control element of the preceeding pre-dryer; and controlling the heating power of several separately controllable heating fields, distributed across the width of said drying tunnel, said controlling being in a correspondent relationship with measured values of the moisture obtained at a measuring position.

2. A process as claimed in claim 1, including at least four measuring positions, across the width of the material, following the infrared pre-drying tunnel.

3. A process as claimed in claim 1, including distributing as many measuring positions across the width of the material as correspond to controllable heating fields in the infrared pre-drying tunnel.

4. A process as claimed in claim 1, wherein the infrared pre-drying tunnel zone includes controllable and pre-set heating field zones.

5. A process as claimed in claim 1, wherein the base-load heating in the infrared pre-drying tunnel remains pre-set and the control lable heating is being regulated via said moisture measurement on the textile material.

6. A process as claimed in claim 1, including connecting the infrared pre-drying tunnel to at least one circulation system for a convective equalization of temperature of radiation, further including controlling the power of said circulation system by means of said moisture measurement.

7. A process as claimed in claim 1, including combining a desired temperature limit and a ventilation limit for said infrared pre-drying tunnel zone with a limiting value controlling step, providing thereby a reference system for a heating power control.

8. A process as claimed in claim 1, including, in combination, measuring said moisture of said textile material and controlling said controllable heating fields by measuring said moisture content based on microwave absorption or microwave reflection and adjusting, in response to said measurement, said controllable heating fields.

9. A process as claimed in claim 1, including, in combination, measuring said moisture of said textile material and controlling said controllable heating fields by measuring said moisture content based on infrared absorption or infrared reflection.

* * * * *